United States Patent [19]

Berger

[11] Patent Number: 4,531,241

[45] Date of Patent: Jul. 30, 1985

[54] HAND GLOVE

[75] Inventor: Saul H. Berger, Hauppauge, N.Y.

[73] Assignee: Grumman Aerospace Corporation, Bethpage, N.Y.

[21] Appl. No.: 657,573

[22] Filed: Oct. 3, 1984

[51] Int. Cl.[3] ..... A41D 19/00

[52] U.S. Cl. ..... 2/161 R; 2/20; 2/159; 2/162

[58] Field of Search ..... 2/16, 18, 20, 159, 160, 2/161 R, 161 A, 167, 158

[56] References Cited

U.S. PATENT DOCUMENTS

| | | | |
|---|---|---|---|
| 1,667,926 | 5/1928 | Browsky . | |
| 2,700,159 | 1/1955 | Denburgh . | |
| 2,858,542 | 11/1958 | Ogg | 2/161 A |
| 3,066,306 | 12/1962 | Thomas . | |
| 3,123,832 | 3/1964 | Kubik . | |
| 3,146,463 | 9/1964 | Wargo . | |
| 3,238,939 | 3/1966 | Stubbs . | |
| 3,369,258 | 2/1968 | Smith . | |
| 3,496,573 | 2/1970 | Kuchar et al. . | |
| 3,581,312 | 6/1971 | Nickels . | |
| 3,583,704 | 6/1971 | Callanan . | |
| 3,598,408 | 9/1971 | Klose . | |
| 3,606,614 | 9/1971 | Dimitroff . | |
| 3,790,168 | 2/1974 | Hashimoto . | |
| 3,871,029 | 3/1975 | Hollman . | |
| 4,011,596 | 3/1977 | Chang | 2/16 |
| 4,047,250 | 4/1977 | Norman . | |
| 4,138,108 | 2/1979 | Robinson . | |
| 4,183,098 | 1/1980 | Knowles, Jr. . | |
| 4,183,100 | 1/1982 | DeMarco | 2/159 |
| 4,198,709 | 4/1980 | Clayton . | |
| 4,228,548 | 10/1980 | Cohen . | |
| 4,374,439 | 2/1983 | Norman . | |

FOREIGN PATENT DOCUMENTS

| | | | |
|---|---|---|---|
| 92427 | 11/1968 | France | 2/159 |

*Primary Examiner*—Louis K. Rimrodt
*Assistant Examiner*—Joseph S. Machuga
*Attorney, Agent, or Firm*—Scully, Scott, Murphy and Presser

[57] ABSTRACT

A hand glove comprising a body, an outside pad and an inside cushion. The outside pad and the inside cushion are secured to outside and inside surfaces of the body respectively and are adapted to terminate below the fingers and inside the thumb and to fit over a major portion of the palm, the wrist, and a portion of the forearm. The inside cushion and the outside pad cushion the palm and the wrist without restricting flexing of the wrist, the thumb, or the fingers.

6 Claims, 5 Drawing Figures

HAND GLOVE

BACKGROUND OF THE INVENTION

This invention generally relates to hand gloves, and more particularly to hand gloves that cushion or absorb the impact or vibrations of hand held vibrating machinery such as rivet guns and jack hammers.

Extensive use of hand held vibrating or impact machinery and/or tools such as rivet guns, bucking bars, jack hammers or paint spray guns over a long period of time may damage the carpal nerve. This nerve extends from an area in the palm of the hand between the thumb and the fourth finger, into the wrist. Prior art gloves or wrist protectors have not been able to completely protect an individual, who often uses heavy, hand held vibrating equipment over a long time, from damage to the carpal nerve while, at the same time, permitting the type of flexing movement of the wrist, thumb and fingers necessary to operate and control the equipment.

For example, U.S. Pat. Nos. 4,183,098, 4,138,108, 3,871,029, and 3,123,832 disclose gloves that are designed to help bowlers hold the wrist and hand straight while rolling a bowling ball. These gloves do not allow the type of hand and wrist movement needed to effectively and properly operate hand held equipment such as jackhammers and paint spray guns. U.S. Pat. Nos. 3,606,614 and 3,581,312 illustrate sport training gloves having protuberances adapted to extend outward from the palm to teach a person to control an object such as a basketball by the fingertips. These gloves discourage a person from grabbing and holding an object in the way necessary to manipulate and control heavy hand held and operated machinery. U.S. Pat. Nos. 3,369,258 and 3,146,463 show hand protectors that protect the palm either from blisters or the like, or from the type of occasional shock that might occur when a person hits a ball with a bat. These protectors are not intended to cushion the wrist and the areas immediately adjacent thereto from the constant shocks that occur when heavy vibrating equipment is held for a long period of time.

SUMMARY OF THE INVENTION

An object of this invention is to prevent damage to the carpal nerve caused by extensive longterm handling of vibrating machinery.

Another object of the present invention is to effectively protect, not only the palm, but also the wrist and the areas immediately adjacent thereto, from the shocks caused by hand held vibrating machinery while, at the same time, not restricting movement of the wrist, thumb, or fingers.

A further object of this invention is to provide a glove that may be effectively used to protect a person from damage to the carpal nerve caused by longterm use of heavy, vibrating equipment and which is adaptable to fit various sizes and configurations of hands and wrists.

These and other objects are attained with a hand glove comprising a flexible and elastic body, a durable and flexible outside pad secured to an outside surface of the body, and a flexible and resilient cushion secured to an inside surface of the body. The body of the glove is adapted to wrap around the palm, the wrist, and a portion of the forearm of the user. The outside pad and the inside cushion are adapted to terminate below the fingers and inside the thumb, and to fit over a major portion of the palm, the wrist, and a portion of the forearm.

The outside pad protects the glove body from wear, and the outside pad and the inside cushion protect the palm and the wrist from shocks and vibrations without restricting flexing of the wrist, the thumb or the fingers. Preferably, a flexible cover is secured to the inside surface of the glove body and extends over the cushion to cover and protect the cushion.

Further benefits and advantages of the invention will become apparent from a consideration of the following detailed description given with reference to the accompanying drawings, which specify and show a preferred embodiment of the invention.

A BRIEF DESCRIPTION OF THE DRAWINGS

Figure 4:
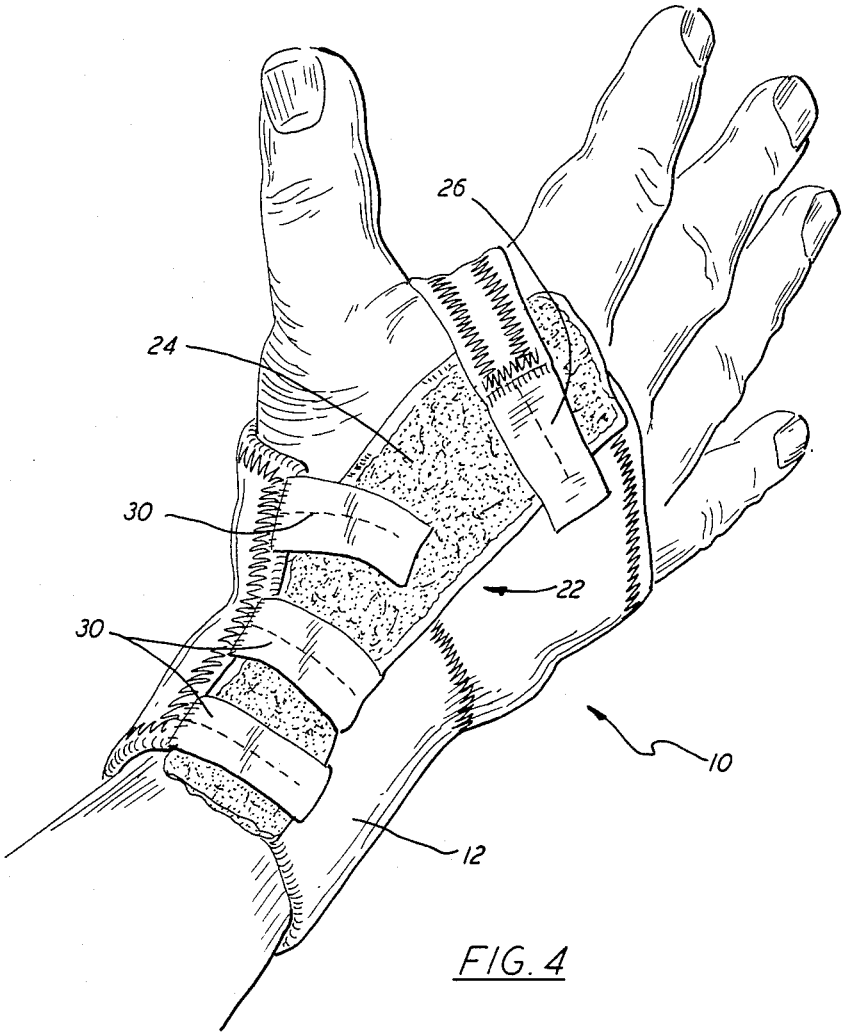

FIG. 4 also shows the glove being worn, and in particular shows the back of the glove.

Figure 1:
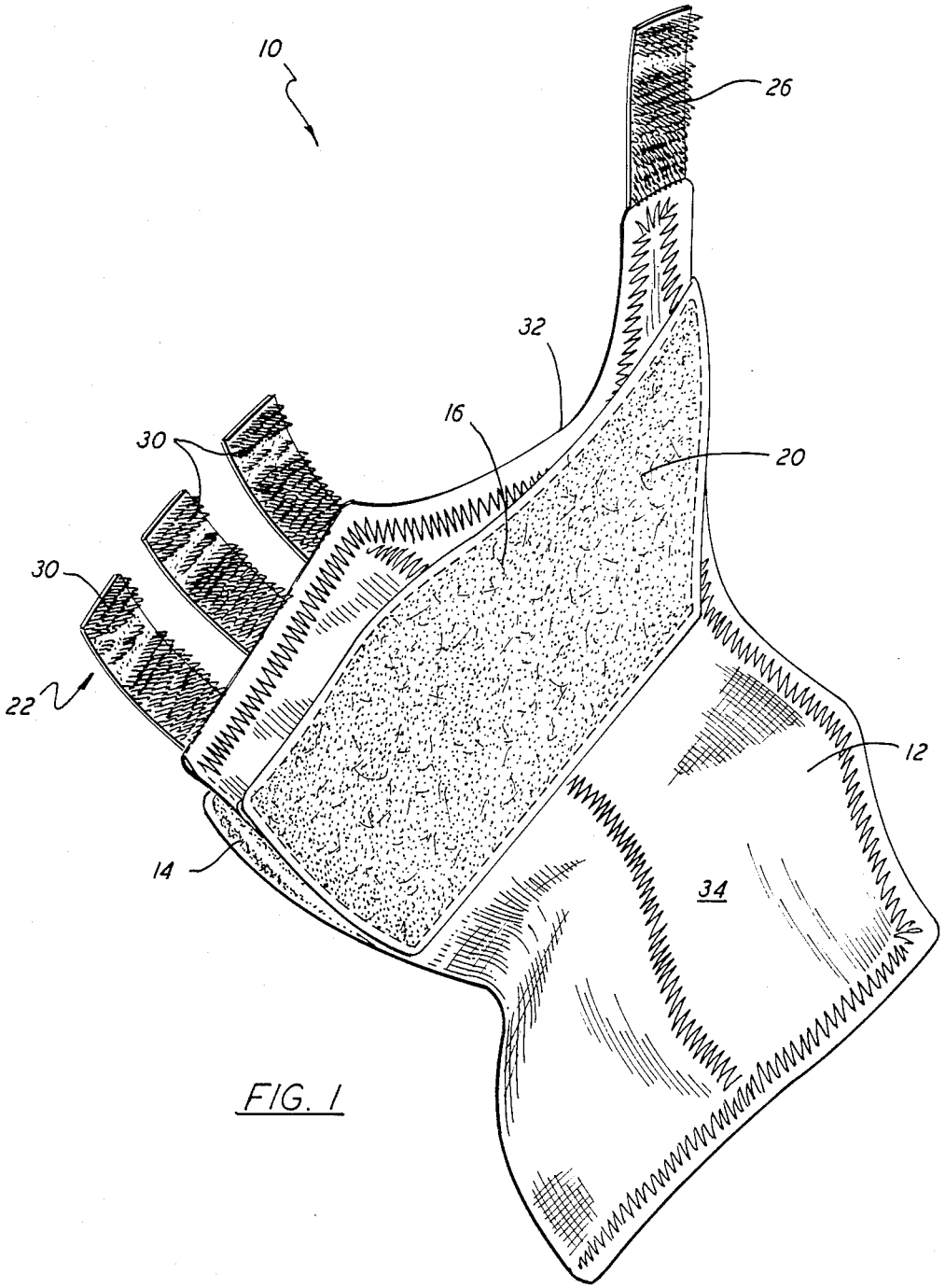
FIGS. 1 is a perspective view showing the inside of a hand glove made in accordance with the present invention.
Figure 2:
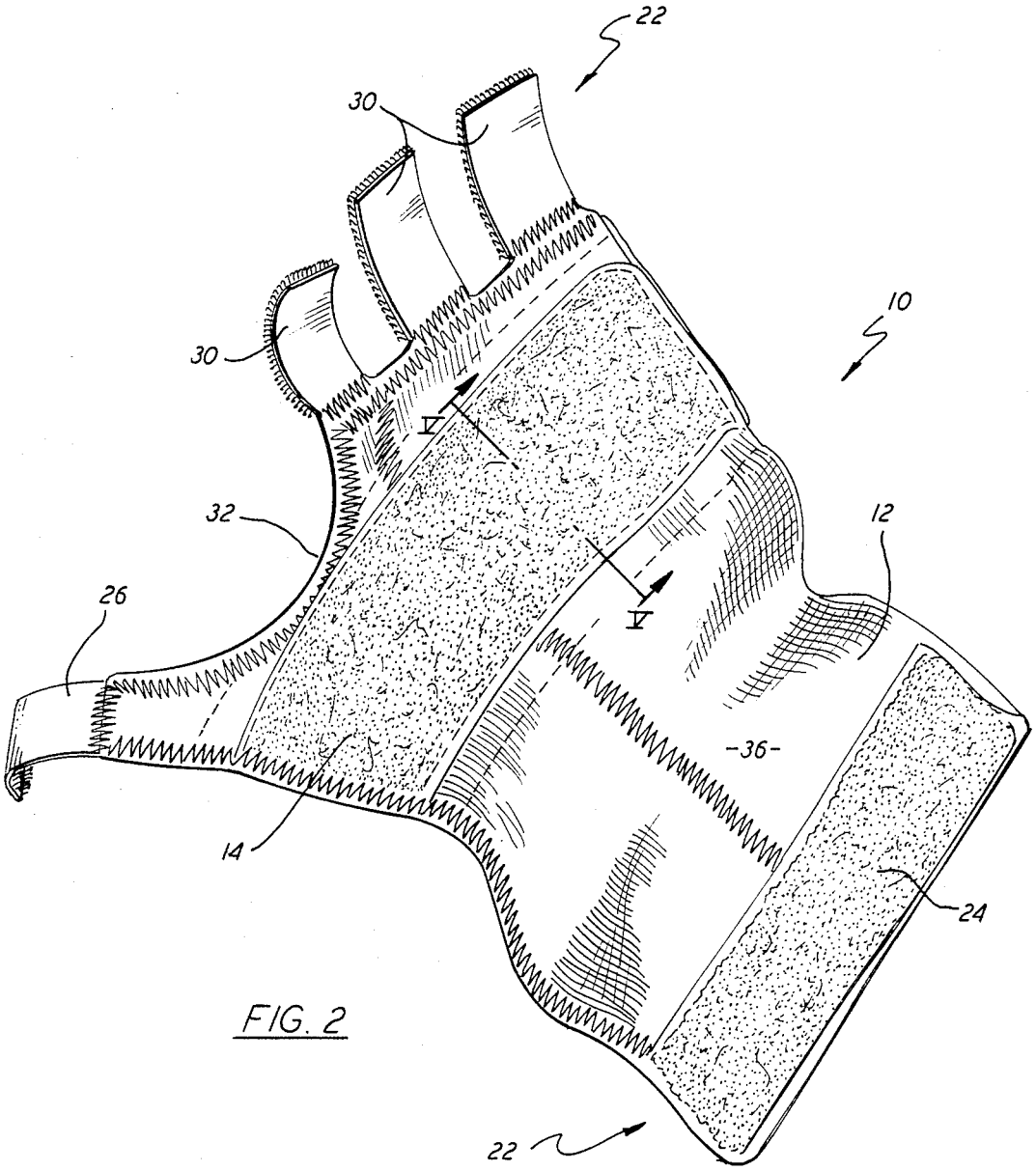
FIG. 2 is a perspective view showing the outside of the glove.
Figure 3:
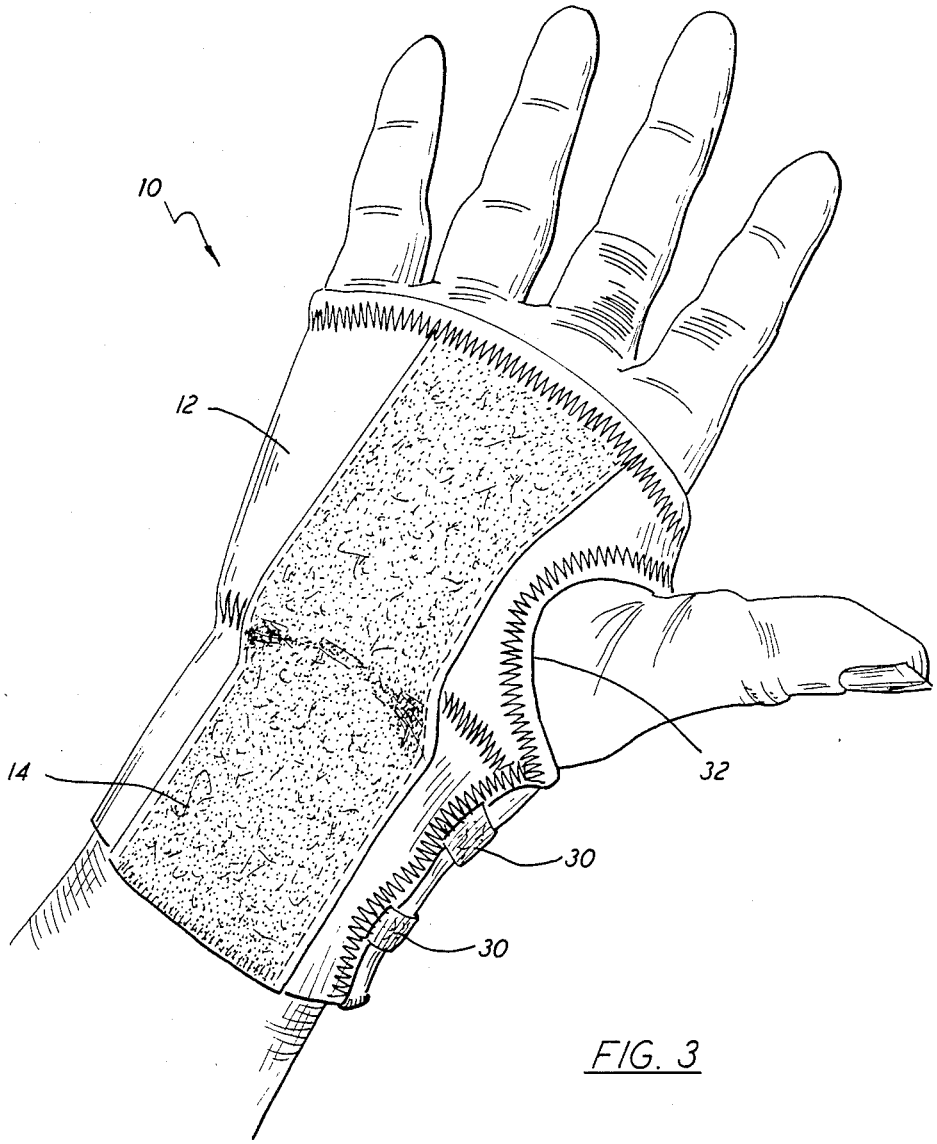
FIG. 3 shows the glove being worn, and in particular shows the front of the glove.
Figure 5:
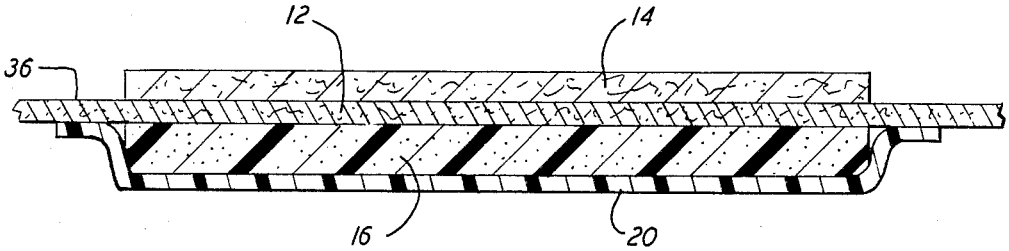

FIG. 5 is an enlarged cross sectional view through a portion of the glove, taken along line V—V of FIG. 2.

DETAILED DESCRIPTION OF THE PREFERRED EMBODIMENTS

FIGS. 1 through 4 illustrate glove 10, which emobodies a preferred form of the present invention. Generally glove 10 comprises body 12, outside pad 14, cushion 16, cover 20, and releasable fastening means 22. Fastening means 22, in turn, comprises attachment means 24, top flap 26, and at least one and preferably a plurality of lower flaps 30.

Glove body 12 is flexible and elastic, allowing the body to stretch and twist to fit comfortably on the hand and upper forearm of a wearer. Body 12 may also be designed to allow air and moisture to pass through the body, further adding to the comfort of the wearer. Numerous types of natural and synthetic materials well known to those skilled in the art may be used to make body 12. Body 12 is adapted to terminate below the fingers, and to wrap around the palm, the wrist, and a portion of the forearm. Preferably, body 12 has a generally rectangular shape, and a first transverse edge of the body has a curved portion 32 forming an opening for receiving the thumb. As is conventional, the surface 34 of body 12 that faces or contacts the skin is referred to as the inside surface of the body, and the surface 36 that faces away from the skin is referred to as the outside surface of the body.

Outside pad 14 is secured, for example by sewing, to outside surface 36 of body 12 adjacent the first transverse edge thereof, and the outside pad is adapted to fit over a major portion of the palm, the wrist, and a portion of the forearm. The primary function of outside pad 14 is to protect from wear the areas of glove body 12 which it covers. Thus, it is important that outside pad 14 be formed from a durable material. At the same time, outside pad 14 must be flexible so that it does not appreciably interfere with flexing the wrist. Moreover, preferably outside pad 14 is partially compressible so that the pad will absorb some of the vibrations of a tool being held by the individual wearing glove 10. Leather is a suitable material for outside pad 14, although other natural or synthetic materials having the desired characteristics may also be used.

Cushion 16 and cover 20 are secured, for instance by sewing, to inside surface 34 of body 12. Specifically, with reference to FIG. 5, cushion 16 is placed directly against inside surface 34, and cover 20 extends directly and completely over the cushion, between the cushion and the skin of the wearer. Like outside pad 14, cushion 16 and cover 20 are adapted to fit over a major portion of the palm, the wrist, and a portion of the forearm of the wearer. The primary purpose of cushion 16 is to absorb shocks from any vibrating machinery or equipment held by the wearer of glove 10. Thus, cushion 16 must be compressible and resilient. The primary function of cover 20 is to cover and protect cushion 16 from dust, dirt, moisture and other matter that, over time, may deleteriously affect the cushion. Further, cushion 16 and cover 20 must be flexible so that they do not appreciably interfere with flexing the wrist. Many suitable materials, such as Ensolite or other rubber or rubber-like materials may be used as cushion 16. Many suitable materials, for instance, nylon, may be used as cover 20.

Outside pad 14, cushion 16 and cover 20 terminate below the fingers and inside the thumb of the wearer so that the outside pad, the cushion, and the cover do not interfere with flexing movement of the fingers or thumb. Preferably, outside pad 14, cushion 16, and cover 20 extend along substantially the entire height of glove body 12, between the longitudinally extending edges thereof. Outside pad 14, cushion 16, and cover 20 have substantially the same rectangular shape and size, with the cover, of course, being slightly wider and longer than the cushion. In assembly, outside pad 14, cushion 16, and cover 20 are positioned with their edges generally aligned, with the cover extending slightly outside cushion 16.

Fastening means 22 is provided to attach the first and second transverse edges of glove body 12 together on the hand and arm of the wearer. More specifically, attachment means 24 is connected to outside surface 36 of glove body 12 adjacent the second transverse edge thereof. Top flap 26 is connected to the first transverse edge of body 12 and is adapted to extend therefrom, above the thumb, into engagement with the attachment means 24 to connect the transverse edges of the body together. Lower flaps 30 are connected to the first transverse edge of the glove body 12 and are adapted to extend therefrom, below the thumb, into engagement with attachment means 24 to connect the transverse edges of the body further together.

While numerous specific arrangements such as snaps or buttons may be used to connect flaps 26 and 30 to attachment means 24, preferably this connection is made by means of a hook-and-burr arrangement, such as is sold under the trademark "Velcro". With this arrangement, flaps 26 and 30 include hook sections, which may be sewn to bases of the flaps, and a burr or pile section is sewn onto glove body 12 to form attachment means 24. Pile 24 extends along the entire height of glove body 12, providing the wearer with substantial flexibility as to exactly where flaps 26 and 30 are secured to the pile. This insures a comfortable, secure and snug fit of the glove on the hand and arm of the wearer.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

What is claimed is:

1. A hand glove comprising:

a flexible and elastic body adapted to terminate below the fingers, and to wrap around the palm, the wrist, and a portion of the forearm of a wearer, the body having opposite first and second transverse edges, the first transverse edge having a curved portion forming an opening to receive the thumb of the wearer;

a durable and flexible outside pad secured to an outside surface of the body adjacent the first transverse edge thereof, and adapted to terminate below the fingers and inside the thumb of the wearer and to fit over a major portion of the palm, the wrist, and a portion of the forearm of the wearer to protect the glove body and to cushion the palm and the wrist without restricting flexing of the wrist, thumb, and fingers;

a flexible and resilient cushion secured to an inside surface of the body adjacent the first transverse edge thereof, and adapted to terminate below the fingers and inside the thumb and to fit over a major portion of the palm, the wrist, and a portion of the forearm to further cushion the palm and the wrist without restricting flexing of the wrist, thumb, and fingers; and releasable fastening means to attach the first and second transverse edges of the glove body together on the hand and arm of the wearer, and including (i) attachment means connected to the outside surface of the body adjacent the second transverse edge thereof, (ii) a top flap connected to the first transverse edge of the body and adapted to extend therefrom, above the thumb, and into engagement with the attachment means to connect the transverse edges of the body together, and (iii) at least one lower flap connected to the first transverse edge of the body and adapted to extend therefrom, below the thumb, and into engagement with the attachment means to connect the transverse edges of the body further together.

2. A hand glove according to claim 1 wherein the outside pad and the cushion extend along substantially the entire height of the body.

3. A hand glove according to claim 2 wherein the outside pad and the cushion have substantially identical, rectangular shapes.

4. A hand glove according to claim 3 further comprising a flexible cover secured to the inside surface of the body and extending completely over the cushion to cover and protect the cushion.

5. A hand glove according to claim 4 wherein the cover extends along substantially the entire height of the body and extends slightly outside the cushion.

6. A hand glove according to claim 5 wherein:

the outside pad is formed from leather;

the inside cushion is formed from a rubber-like material; and the cover is formed from nylon.

* * * * *